US006151920A

United States Patent [19]

Schindler et al.

[11] Patent Number: 6,151,920

[45] Date of Patent: Nov. 28, 2000

[54] CIRCULAR SLIVER KNITTING MACHINE FOR THE PRODUCTION OF KNITWEAR WITH COMBED-IN FIBERS

[75] Inventors: Hartmut Schindler, Albstadt, Germany; Earl Robert Quay; Xuejian Zhu, both of Orangeburg, S.C.; Aiken Anderson Still, IV, North, S.C.

[73] Assignee: Sipra Patententwicklungs- u. Beteiligungsgesellschaft mbH, Albstadt, Germany

[21] Appl. No.: 09/432,504

[22] Filed: Nov. 3, 1999

[30] Foreign Application Priority Data

Nov. 7, 1998 [DE] Germany ..... 198 51 403

[51] Int. Cl.[7] ..... D04B 9/14

[52] U.S. Cl. ..... 66/9 R; 66/9 B

[58] Field of Search ..... 66/8, 168, 191, 66/9 R, 80, 83, 9 B

[56] References Cited

U.S. PATENT DOCUMENTS

| | | | |
|---|---|---|---|
| 4,245,487 | 1/1981 | Schaab et al. | 66/9 B |
| 4,458,506 | 7/1984 | Artzt et al. | 66/9 B |
| 5,134,863 | 8/1992 | Hanna | 66/9 B |
| 5,431,029 | 7/1995 | Kuhrau et al. | 66/9 B |
| 5,809,804 | 9/1998 | Kuhrau et al. | 66/9 B |

FOREIGN PATENT DOCUMENTS

| | | | |
|---|---|---|---|
| 2608177 | 1/1984 | France | 66/9 B |
| 26 33 912 | 3/1977 | Germany . | |
| 33 22 489 A1 | 12/1983 | Germany . | |
| 32 47 957 A1 | 6/1984 | Germany . | |
| 25 60 526 C2 | 5/1985 | Germany . | |
| 2122653 | 1/1984 | United Kingdom | 66/9 B |
| 95/25191 | 9/1995 | WIPO . | |

*Primary Examiner*—Danny Worrell
*Attorney, Agent, or Firm*—Michael J. Striker

[57] ABSTRACT

A circular knitting machine for the production of knitwear formed of yarns and fibers tied into these yarns is described. The circular knitting machine contains a needle cylinder (1) with knitting needles (2), a sinker ring (15) which is rotatable about an axis of rotation jointly with the needle cylinder (1) and has sinkers (16), a stationary cylinder cam and sinker cam means which is associated with the knitting needles and sinkers, respectively, yarn and fiber feed units, an air guiding unit (45) provided with at least one suction nozzle and/or blowing nozzle, and a control cam (85) for acting upon the inserted fiber tufts. The arrangement is carried out in such a way that initially loops are formed from the yarn and the fiber tufts, wherein the fiber tufts are directed essentially toward the axis of rotation, that the direction of the fiber tufts is then substantially reversed by the air guiding unit (45), and that the reversed fiber tufts **(44*a*) are laid over adjacent sinkers by the control cam so that they can take part at least once in a loop forming process. According to the invention, the air guiding unit (45) has a free space (69) arranged on the front side (55) of the knitting needles (2) and above the sinkers (16), which free space (69), considered in the rotating direction of the needle cylinder (1), extends essentially from a location (49) at which the raising of the knitting needles (2) starts up to the beginning of the control cam (85) and in a direction parallel to the axis of rotation until close to the upper edges (70) of the sinkers (16)**.

21 Claims, 13 Drawing Sheets

Fig. 10
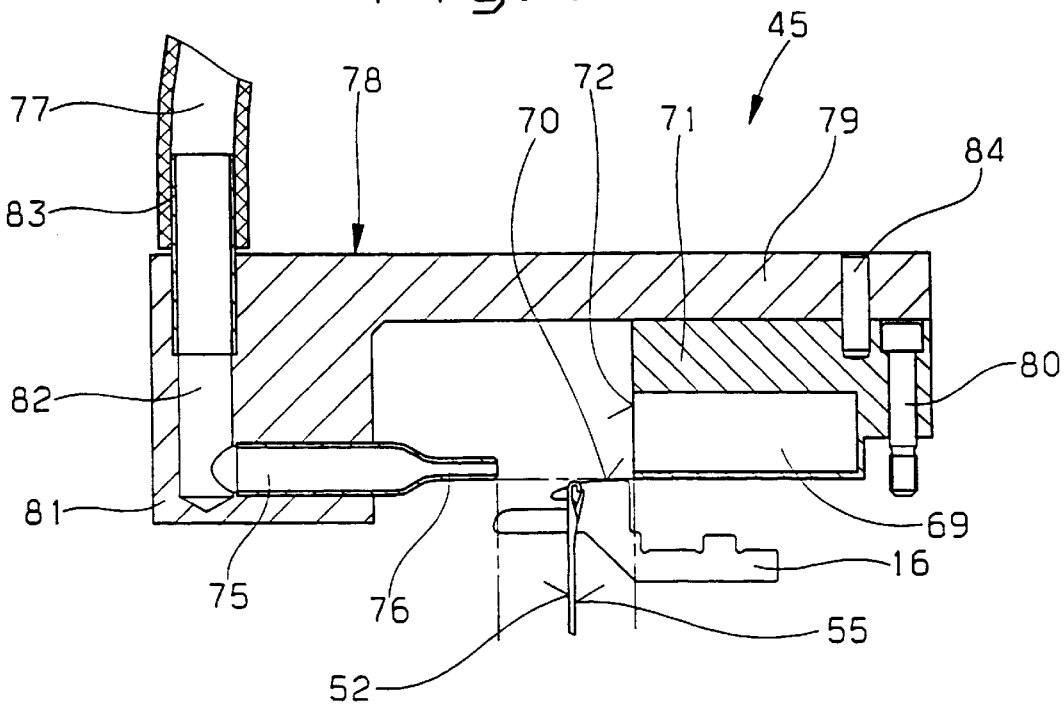
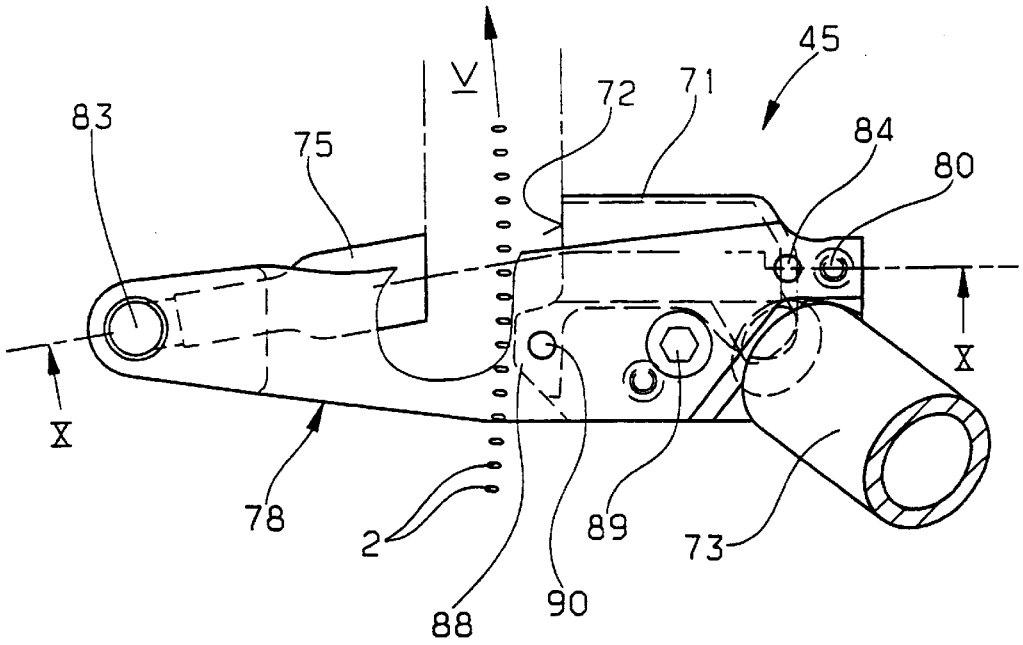
Fig. 11

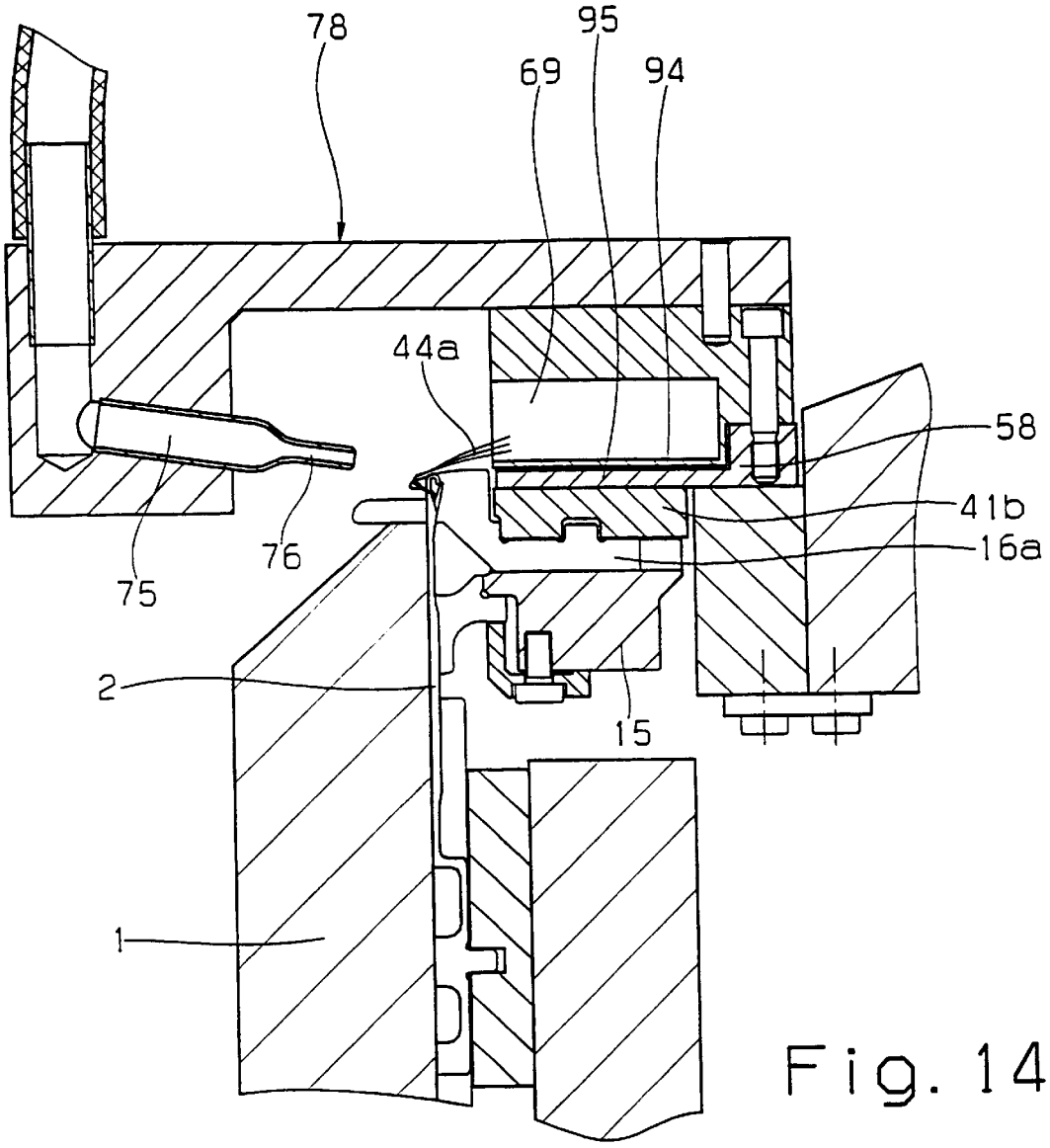
Fig. 14
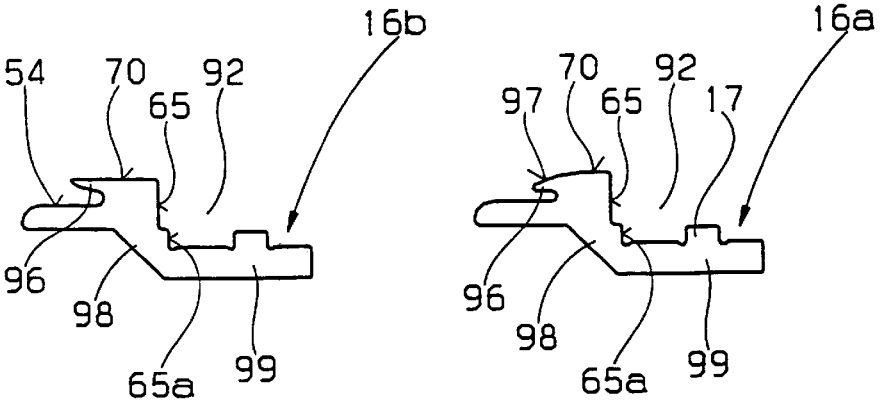

CIRCULAR SLIVER KNITTING MACHINE FOR THE PRODUCTION OF KNITWEAR WITH COMBED-IN FIBERS

BACKGROUND OF THE INVENTION

The invention is directed to a circular knitting machine for the production of knitwear having combed-in fibers, also called circular sliver knitting machine.

Knitting machines of this type normally comprise a needle cylinder with knitting needles, a sinker ring with sinkers having upper edges and being mounted so as to be rotatable about an axis of rotation jointly with the needle cylinder, and a stationary cylinder cam and sinker cam means associated with the knitting needles and sinkers, respectively. The cam means form at least one knitting system extending in the rotating direction of the needle cylinder, which knitting system has at least one cylinder cam part for raising and drawing off the knitting needles, yarn and fiber feed means for feeding and inserting the yarn and fiber tufts in raised knitting needles, at least one sinker cam part for advancing and retracting the sinkers and an air guiding unit provided with at least one suction nozzle and/or blowing nozzle. The cylinder cam part and sinker cam part means, the yarn and fiber feed means and the air guiding unit are so constructed and arranged relative to one another that initially loops are formed from the yarn and the fiber tufts with the fiber tufts being directed essentially toward the axis of rotation, and that the direction of the fiber tufts is then substantially reversed by the air guiding unit. The reversed fiber tufts are laid over adjacent sinkers so that they can take part at least once in a loop forming process when passing through the same knitting system or another knitting system.

In circular knitting machines for producing knitwear containing combed-in fibers, also known as high-pile goods, the fibers are normally inserted into the hooks of the knitting needles by means of combing-in cylinders (doffer rolls) in such a way that the free ends of the fibers lie on the back of the needles and on the inner side of the knitwear, i.e., they are directed toward the axis of rotation of the needle cylinder. In order to facilitate the tying in of the fibers and to enable short pile lengths (short-pile goods) without suffering large combing-in losses and shearing losses, circular knitting machines for producing knitwear with combed-in fibers are already known, wherein the position of the fiber tufts inserted in the knitting needles is reversed after loop formation in such a way that their free ends are directed away from the axis of rotation of the needle cylinder, are arranged on the front sides of the knitting needles, lie diagonally over the upper edges of the sinkers and are therefore once again grasped by the knitting needles during the next loop forming process and are tied into the knitwear. Depending on the length of the fibers, these processes can also be repeated a number of times in succession, in which case the fibers which are worked to form a first loop are subsequently tied into the knitwear over several adjacent needle wales at least in the form of loops or tuck loops at a number of locations.

In order to produce short-pile knitwear of this type, which is occasionally also referred to as reverse loop sliver knit fabrics, there are known circular knitting machines (U.S. Pat. No. 4,245,487) having blowing nozzles serving to reverse the ends of the fibers. These blowing nozzles are arranged on the inner side of the needle cylinder, approximately at the location where the knitting needles are gradually raised again after a loop formation in order once again to receive yarns and fibers, and extend substantially radial to the knitting needles. However, apart from the blowing nozzles, these circular knitting machines do not possess means by which it would be possible to reverse the ends of the fibers in a controlled and uniform manner such as would be required for producing saleable knitwear.

In a known circular knitting machine of the generic type mentioned above (U.S. Pat. No. 5,431,029), the reversal of the fibers is likewise carried out by means of blowing nozzles facing radially outward. The chief problem in this respect consists in that a carrier for the cam controlling the sinkers is arranged, considered in the direction of flow, behind the outlet opening of the blowing nozzles, wherein the air jets coming from the blowing nozzles are reflected at the carrier and are deflected upward, so that the reversed fibers are directed away from the knitwear rather than toward the knitwear. In addition, the knitting needles are subjected not only to the air jets of the blowing nozzles, but also to the suction effect of an exhaust hood arranged above the circular knitting machine and that of additional suction nozzles which are arranged on the front sides of the knitting needles and serve to suck out excess and free-floating fibers. Accordingly, not only are there obstructions in the flow paths of the blown air coming from the blowing nozzles which impede the formation of uniform air flows which reliably bring about the reversal of fibers, but there also occurs in the area of the knitting needles compulsorily uncontrollable whirling air which likewise impedes a uniform reversal of fibers. For this reason, the blowing nozzles are accompanied by complicated and technically elaborate adjustment and alignment devices to enable precise adjustment of the blowing nozzles, also depending on the fiber length used in individual cases, and so that the blowing nozzles can be oriented in such a way that a favorable reversal of fibers is achieved. This requires laborious adjustment and alignment work which relies to a great extent on trial and error and should therefore be avoided.

SUMMARY OF THE INVENTION

In view of the above background, it is an object of the invention to improve the sliver knitting machine mentioned above in such a way that a uniform reversal of fibers can be achieved.

A further object of the invention is to achieve a uniform reversal of the fibers independent to a great extent from the type of fibers used.

Yet another object of the invention is to provide a knitting machine for producing knit fabrics with combed-in fibers and to achieve a uniform reversal of the fibers independent from the knitwear to be produced.

According to still another object of the invention the knitting machine is to be designed such that it is simple in construction and does not require wasteful adjustment work to achieve proper fiber reversal.

These and other objects, features and advantages of the present invention are obtained by providing a sliver knitting machine of the type mentioned above wherein the air guiding unit has a free space arranged on the front side of the knitting needles and above the sinkers, which free space, considered in the rotating direction of the needle cylinder, extends essentially from a location at which the raising of the knitting needles starts, along a preselected portion of a subsequent raising portion, and in a direction parallel to the axis of rotation until close to the upper edges of the sinkers.

The invention has the advantage that by creating a free space in front of the knitting needles and above the sinkers, air flow paths are formed which are free from obstacles, generate practically no detrimental whirling of air, and accordingly enable a uniform reversal of fibers regardless of whether the air guiding unit works with a suction nozzle, a blowing nozzle or both.

The invention will be described more fully hereinafter in connection with the accompanying drawings with reference to embodiment examples.

BRIEF DESCRIPTION OF THE DRAWINGS

FIG. 10 shows a section along line X—X of FIG. 11;

FIG. 11 shows a top view of an air guiding unit according to the invention shown in FIG. 9;

FIGS. 14 to 16 show sections corresponding to FIG. 9 through additional embodiment forms of the air guiding unit according to the invention.

DESCRIPTION OF THE PREFERRED EMBODIMENT

Figure 1:
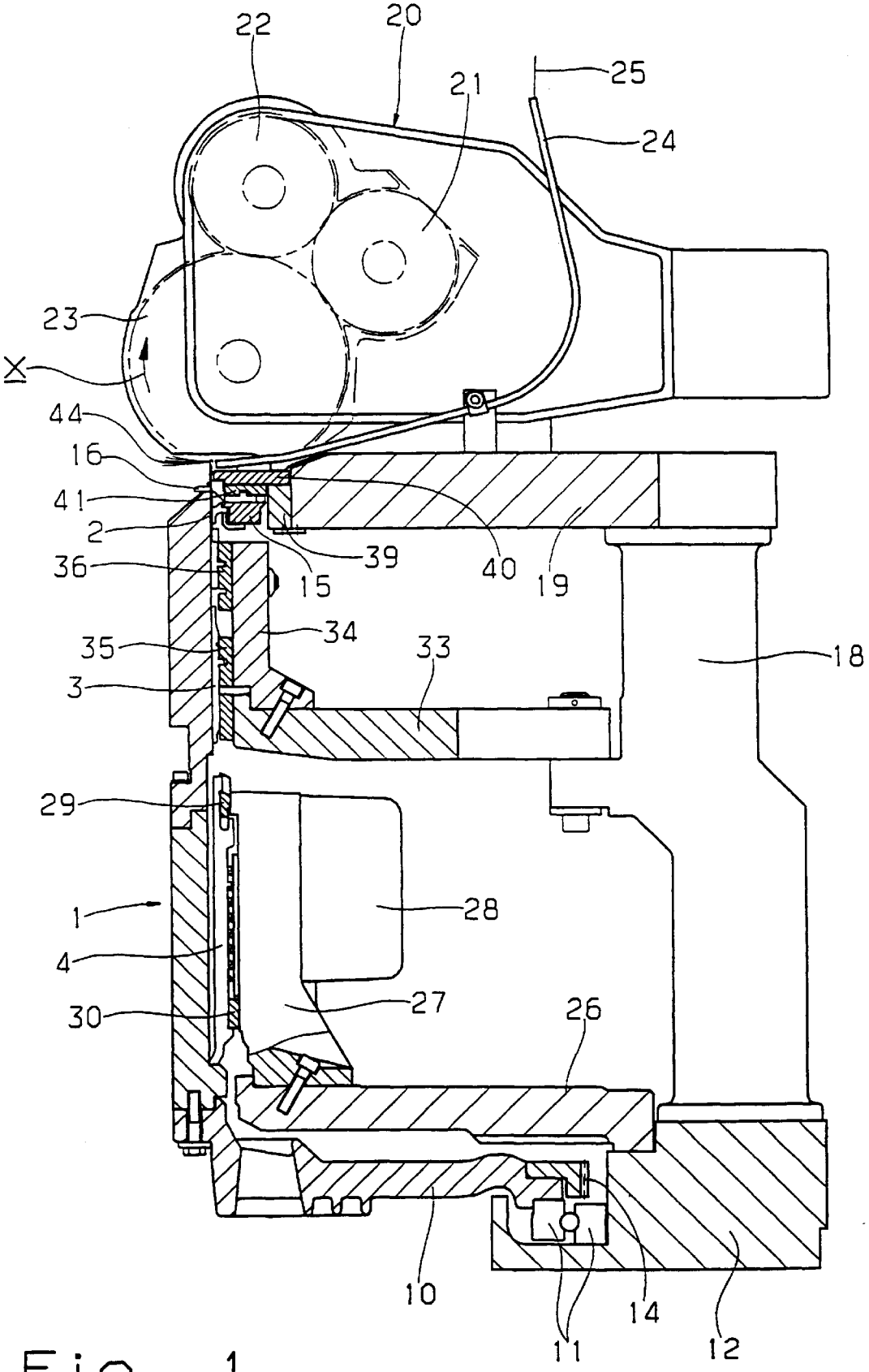
FIG. 1 shows a schematic vertical section through a circular knitting machine, according to the invention, for the production of knitwear with combed fibers.
Figure 2:
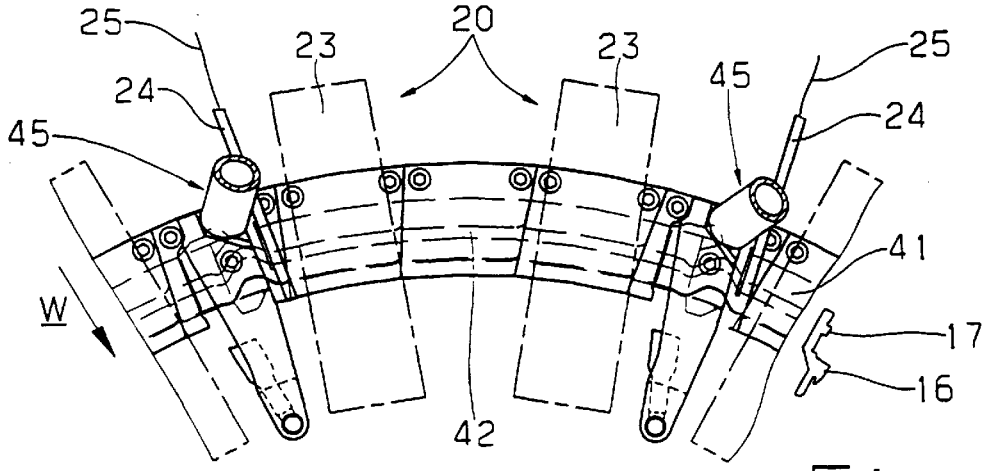
FIG. 2 shows a schematic top view of part of a sinker cam of the circular knitting machine according to FIG. 1.
Figure 3:
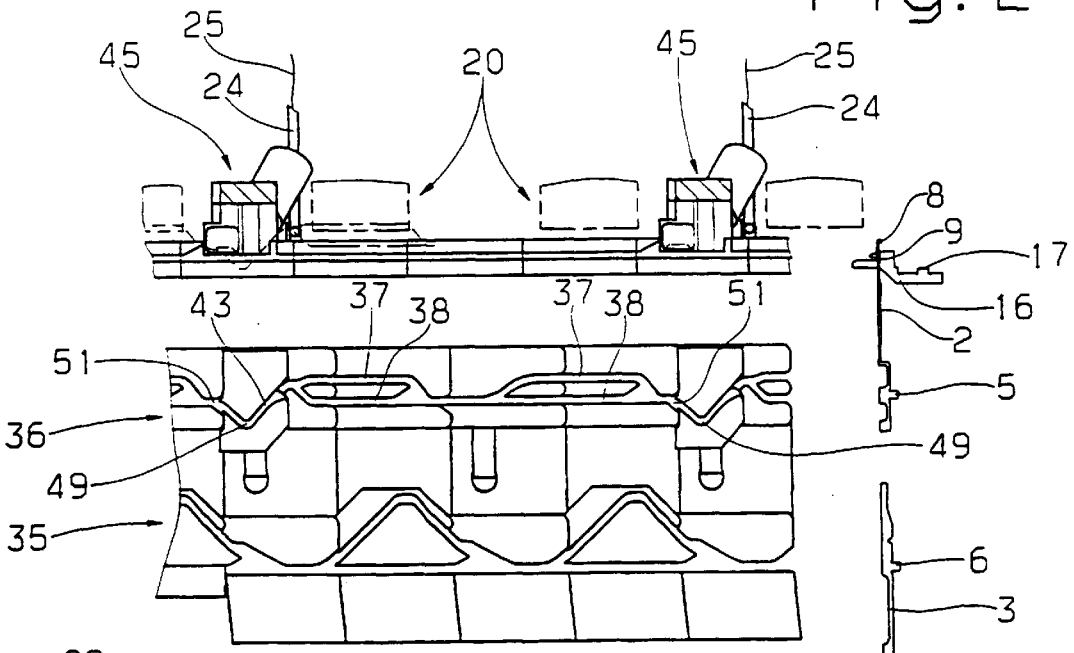
FIG. 3 shows a view of the sinker cam according to FIG. 2 and a cylinder cam of the circular knitting machine according to FIG. 1 considered from the inner side without the needle cylinder and sinker ring.

With reference to FIGS. 1 to 3, a circular knitting machine according to the invention contains a needle cylinder 1 which is rotatably mounted in a machine frame, not shown in more detail, and can be rotated about an axis of rotation which extends vertically with reference to FIG. 1, but which is not shown. The needle cylinder 1 has vertical, parallel grooves in which, from top to bottom, knitting needles 2, intermediate needles 3 and pattern jacks 4 are mounted so as to be vertically movable up and down and, if necessary, swivelable and are provided with butts 5, 6 and 7 (FIG. 3). The knitting needles 2 are advisably conventional latch needles having hooks 8 and swivelable latches 9 associated therewith. The needle cylinder 1 is fastened at its underside to a cylinder carrier ring 10 which is supported by means of bearings 11 so as to be rotatable in a stationary carrier ring 12 and is provided at its circumference with a toothing 14 which communicates with a drive gearwheel, not shown, driven by a motor.

A sinker ring 15 is fastened to the upper end and to the outer side of the needle cylinder 1 in a manner familiar to persons skilled in the art and can rotate together with the needle cylinder 1 about the axis of rotation and has radial slots in which sinkers 16 (FIGS. 2 and 3) are supported by butts 17 so as to be displaceable radial to the axis of rotation.

A carrier rim 19 is fastened above the needle cylinder 1 by means of columns 18 which are supported on the carrier ring 12, at least one fiber feed device 20 being mounted at the upper side of the carrier rim 19. In the embodiment example, this fiber feed device 20 is formed of a conventional card, shown only schematically, which has a drum 21 to which fibers are supplied in the form of a sliver or tape, not shown, a homogenizing roller 22 and a combing-in roller 23 or doffer from which the fibers, after conventional processing in the form of fiber tufts, are given to the knitting needles 2 when the latter pass through card clothing located on the combing roller 23. Further, a yarn feed device 24 is arranged directly behind the fiber feed device 20 in the rotating direction of the needle cylinder; in the embodiment example, this yam feed device 24 is formed of a yarn guide in the form of a yarn guide tube through which a yam 25 is fed to the knitting needles 2.

Fastened to the carrier ring 12 is a cam ring 26 supporting a bottom cylinder cam portion 27 which is arranged at the circumference of the needle cylinder 1 and which has assigned to it a patterning mechanism 28 serving to act on the pattern butts 7 of the jacks 4 and which has, on its inner side, cam parts 29, 30 which cooperate with additional butts 31, 32 of the jacks 4. Another cam ring 33 is fastened to the columns 18. It carries an upper cylinder cam portion 34 which is arranged at the circumference of the needle cylinder and is provided at its inside (e.g., FIGS. 1 and 3) with cam parts 35 for the butts 6 of the intermediate needles 3 and with cam parts 36 for the butts 5 of the knitting needles 2. In this regard, the cam parts 29, 30, 35 and 36, the patterning mechanism 28, the knitting needles 2, the auxiliary needles 3, and jacks 4 cooperate in such a way that when the needle cylinder rotates in the direction of arrow v (FIG. 3) the cam parts 29, on the one hand, raise only pattern jacks 4 which are selected by the patterning mechanism 28 and which then transfer their raising movement via the intermediate needles 3 to the knitting needles 2 and raise their butts into a higher track or path portion 37 formed by the cam parts 35. On the other hand, pattern jacks 4 which are not selected are not brought into the effective area of the cam parts 29, so that the butts 5 of the respective knitting needles 2 are guided into a lower path portion 38 extending substantially at tucking height.

According to FIG. 1, a sinker cam carrier 39, for example, an annular sinker cam carrier 39, is fastened to an inner portion of the carrier rim 19, wherein at least one sinker cam segment 40 which extends in the circumferential direction of the circular knitting machine and radially inward over the sinker ring 15 and sinkers 16 is arranged at the sinker cam carrier 39. At least one sinker cam part 41 is fastened to the underside of the sinker cam segment 40, acts on the sinker butts 17 and guides the latter in a path 42 (FIG. 2), along which these sinker butts 17 are advanced or withdrawn radially during rotation of the sinker ring 15.

The fiber feed device and yam feed means 20 and 24, respectively, and the cylinder cam portions 27 and 34 form a knitting system which serves to lift selected knitting needles 2, or all knitting needles 2, before passing the respective combing-in roller 23 so that they take up fibers and subsequently draw them off again, wherein they take up yarn 25, in addition, and work it together with the taken up fiber tufts to form loops in which the knitting needles 2 are drawn off into a knock-over or cast off position by means of a take-off cam 43 (FIG. 3) formed by cam parts 36. The sinkers 16 are controlled by the path 42 in such a way that they are displaced in the direction of the axis of rotation (arrow w in FIG. 2) before the raising of the knitting needles 2 in order to clear the previously formed loops, while they are briefly drawn back after the take-up of the fiber and yam so that new loops can be formed without hindrance.

The combing-in roller 23 is rotated, according to FIG. 1, in the direction of an arrow x in such a way that fiber tufts 44, shown schematically, are wrapped around the hooks 8 of the knitting needles 2 in a roughly U-shaped or J-shaped manner and are oriented with their free ends radially inward, i.e., in the direction of the axis of rotation. The majority of the fibers lie on the inside in the finished knit. On the other hand, if it is desirable to arrange the fibers or their ends entirely or partially on the outside of the knitwear, a special air guiding unit 45, shown schematically in FIGS. 2 and 3, is provided in addition, this air guiding unit 45 serving to orient the fiber tufts 44 in such a way, in contrast to FIG. 1, that they are rotated by approximately 180 on the needle stems and are then directed outward, i.e., away from the axis of rotation of the machine. An arrangement of the air guiding unit 45 according to the invention is described in more detail hereinafter. With reference to the rotating direction of the needle cylinder 1, the air guiding unit 45 is arranged behind the location at which the knitting needles according to FIG. 3 reach the cast off position, so that the reversal of the fiber tufts 44 is always carried out only when they have already been anchored in the knitwear.

Finally, it is self-evident that a plurality of knitting systems can advantageously be arranged at the circumference of the needle cylinder 1 and sinker ring 15, these knitting systems having at least one yarn feed device and fiber feed device 24 and 20, respectively, and associated cylinder cam parts and sinker cam parts 29, 30, 35, 36 and 41, so that several courses with combed fibers can be formed with every revolution of the needle cylinder 1. In this respect it is also possible, as is shown in FIGS. 2 and 3, to provide in every knitting system two or more fiber feed devices 20 supplying fibers with different characteristics, e.g., colors, and a corresponding quantity of associated path portions 37, 38. In this case, the arrangement is carried out in such a way that the knitting needles 2 initially, in accordance with the pattern, take up fibers at one of the associated doffer rollers 23 (path portions 37), while they pass the rest of the doffer rollers 23 along path portions 38 without taking up a fiber and in such a way that all knitting needles 2 take up the yarn 25 before running up on a common drawing-down cam 43. In this way, every loop within a course contains the fibers of a selected characteristic.

Figure 4:
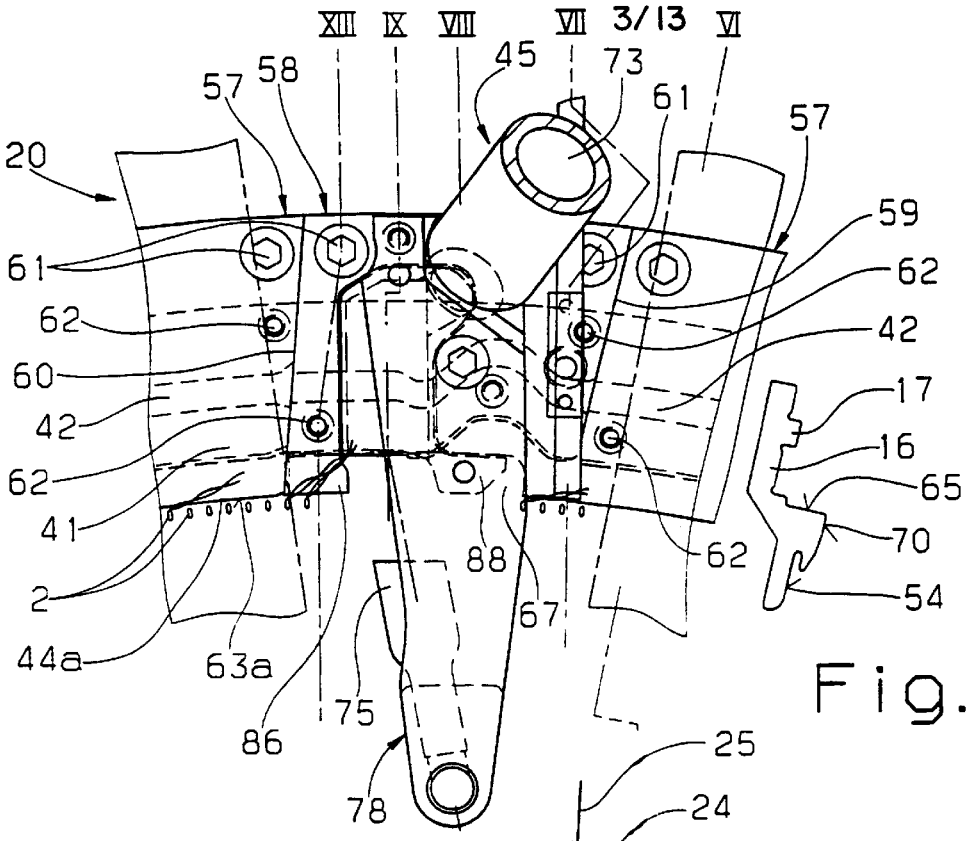
FIGS. 4 and 5 are enlarged views of correspondingly shown sections of the cam arrangements according to FIGS. 2 and 3 in the region of an air guiding unit according to the invention.
Figure 5:
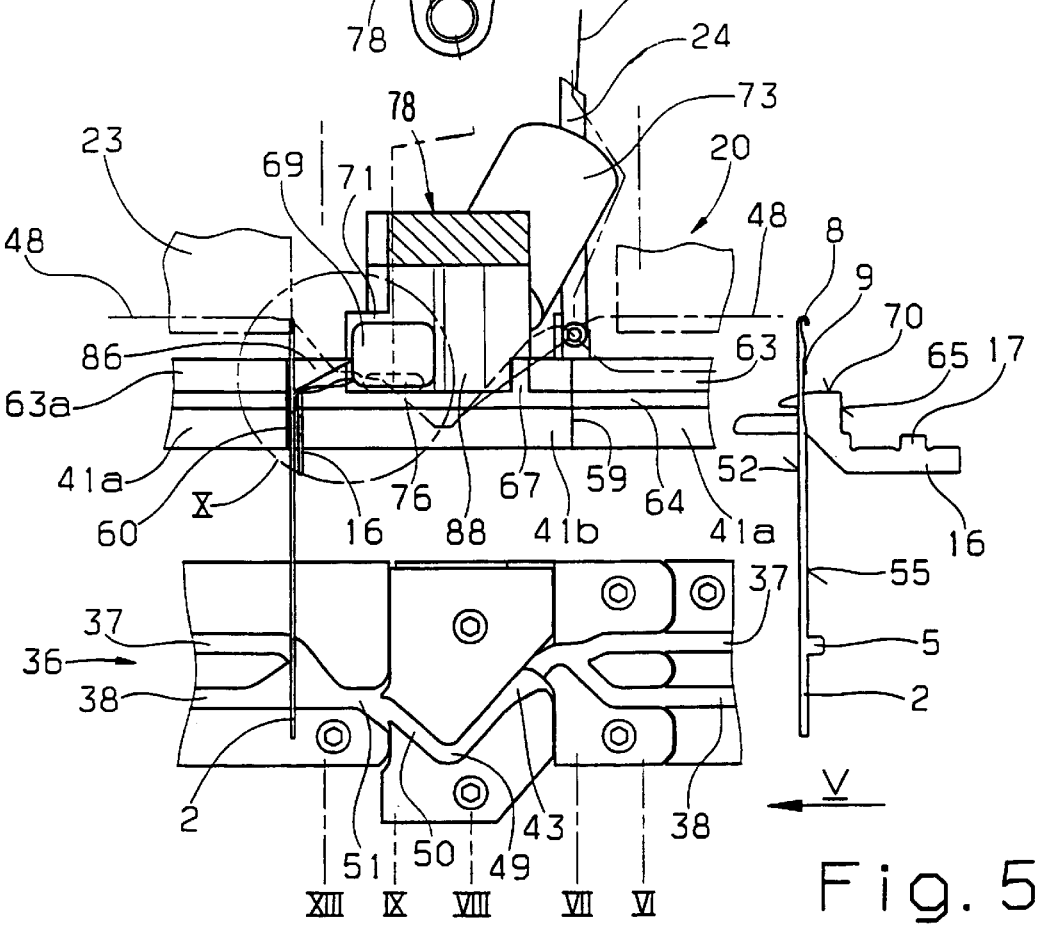

As can be seen from FIGS. 4 and 5 in particular, the sinker butts 17 traverse the path 42, while the needle butts 5 are initially guided either in path portion 37 or in path portion 38 and, at the end of these path portions 37, 38, run up on the drawing-down cam 43 from which they are drawn down for loop formation in a lowest position designated as cast off point or loop forming point 49 (FIG. 5). The loop forming point 49 in the bottom area of FIG. 5 is associated with the path traversed by the needle butts 5. Naturally, at the same location the hooks 8 of the knitting needles 2 also traverse a lowest point along a path 48 shown in dashed lines in the upper part of FIG. 5. Behind the loop forming point 49, considered in the rotating direction of the needle cylinder 1, the butts 5 of the knitting needles 2 are raised again along a path portion 50 until they reach a location 51 at a height at which the path portions 37 and 38 of a subsequent knitting system begin. At this location 51, a selection may be made, e.g., by means of the patterning mechanism 28 (FIG. 3), about whether a knitting needle 2 should be guided in path portion 37 or path portion 38 of the subsequent knitting system. But the patterning mechanisms 28 can also be omitted when all of the knitting needles 2 are to be controlled in path portion 37 and take up the same fibers. The beginning of the fiber feed device 20 of the subsequent knitting system can also be situated at location 51 as is shown in FIGS. 4 and 5. Therefore, the entire cam portion situated between two successive locations 51 can be called a knitting system; it does not matter, in principle, whether a knitting system contains only one fiber feed device 20 or several fiber feed devices 20 or whether or not it is possible at the beginning of the knitting system to guide the feet S of the knitting needles 2 in path portion 37 or path portion 38 in a selected manner.

In circular knitting machines of the type presently under consideration, the reversal of the fiber tufts 44 is carried out in that part of each knitting system that was just described, i.e., between the loop forming point 49 and location 51. Therefore, the air guiding unit 45 required for this purpose is also arranged in and is effective in this part.

The circular knitting machine described up to this point operates essentially in the following manner:

When the knitting needles 2 run into a knitting system in the rotating direction of the needle cylinder 1 (arrow v in FIGS. 3 and 5), they are distributed on the path portions 37 and 38, respectively, according to pattern. The process of taking up the fiber is shown particularly in FIG. 6 in which the knitting needles 2 following the path portion 37 are fully raised and their hooks 8 traverse the cards, not shown, of the combing-in roller 23. In so doing, the fiber tufts 44 are combed into the hooks 8 and are oriented in the described manner essentially radially inward and to the back sides 52 (FIGS. 5, 6) of the knitting needles 2. The sinkers 16 are located in their fully advanced position so that they clear the last course of an already finished knitwear 53 in a known manner.

Figure 7:
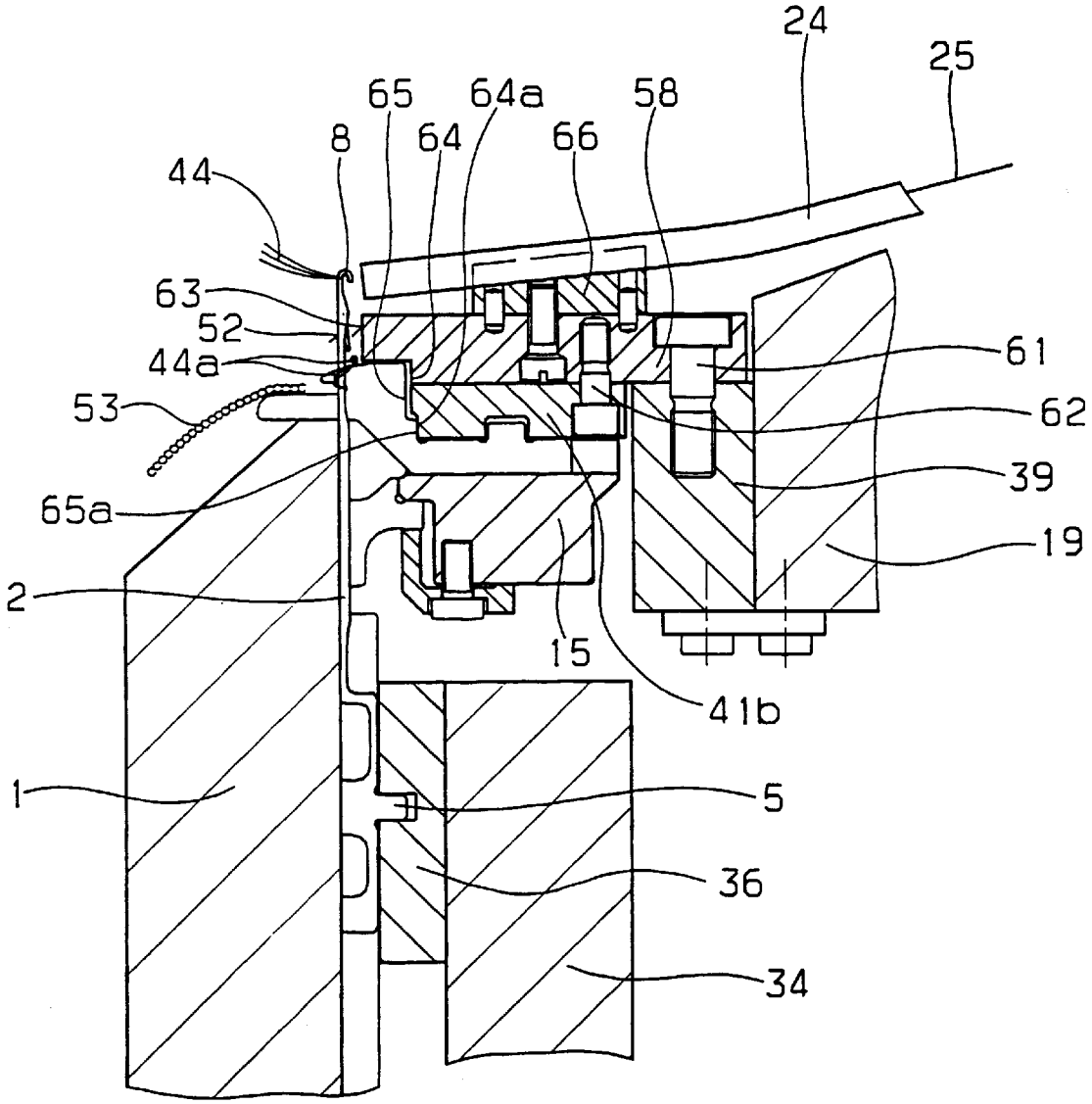

Directly behind the fiber feed device 20, the yarn 25 is offered to the hooks 8 of the knitting needles 2 by the yarn feeding means 24 as is shown, e.g., in FIGS. 1, 5 and 7.

The butts 5 of the knitting needles 2 reach the drawing-down cam 43 and are drawn off by the latter until the loop forming point 49 (FIG. 5). Consequently, the knitting needles 2 form a new course from the fiber tufts 44 and the inserted yam 25. The sinkers 16 are now in a retracted position so that the hooks 8 can be lowered below cast off edges 54 (FIGS. 4 and 8) in order to form the new loops over the latter.

Following the loop formation, the knitting needles 2 are raised again along the path portion 50 shown in FIG. 5 until they reach location 51 at the end of the described knitting system. Before this, however, the sinkers 16 are advanced again in order to clear the new loops. Moreover, in a preselected area situated between locations 49 and 51, the fiber reversal under consideration is carried out by means of the air supply unit 45 in that the fiber tufts 44 are moved out of their position according to FIG. 8 into the position according to FIG. 9. In this position, they are essentially located entirely in front of the front sides 55 (FIGS. 5 and 9) of the knitting needles 2. In this case, they should project away from the axis of rotation of the needle cylinder 1 in such a way that they preferably lie diagonally over the sinkers 16 corresponding to FIG. 4. In this way, after the knitting needles 2 have once again taken up yarns, and possibly also fibers, in a subsequent knitting system, reversed fiber tufts 44*a* (FIG. 7) can once again be inserted into their hooks 8 and tied into the knitwear 53 during the next lowering of the knitting needles 2 according to FIG. 7.

Circular knitting machines of the type described herein are well known in general to persons skilled in the art and therefore need not be described more fully. To avoid repetition, reference is had, for example, to U.S. Pat. No.

4,245,487, 5,431,029 and 4,111,006 which are hereby made the subject matter of the present disclosure by reference.

FIGS. 4 to 12 show details of a sinker cam and an air guiding unit 45 which is integrated therein according to an embodiement, the invention considered to be the best one up to now. According to FIG. 4, the sinker cam is divided into a plurality of segments 57, 58 which succeed one another in the circumferential direction, adjoin one another along dividing lines 59, 60 and are fastened to the sinker cam carrier 39 (see also FIGS. 6 and 7) by screws 61. Every segment 57, 58 is stepped at the side facing the needle cylinder 1. In this respect, according to FIG. 6, a surface located farther inward radially serves as a latch guard 63 and a surface located below the latter and farther outward radially serves as a relief cut 64 for backs 65 (FIG. 4) of the sinkers 16. Sinker cam parts 41*a*, 41*b* (FIGS. 6 and 7 to 9), which are preferably constructed in one piece and provided with a track or channel forming the path 42 for the sinker butts 17 are fastened below the segments 57, 58 by means of screws 62. The cam parts 41*a*, 41*b* end with their radially inner end faces flush with the relief cut 64 and, in a lower area with a stepped guide surface 64*a*, serve to guide shoulders 65*a* which project toward the rear and which are formed at the lower ends of the backs 65 of the sinkers 16. In this way, an air gap is formed between the backs 65 and the relief cut 64, so that the backs 65 of the sinkers 16 are extensively free.

Figure 6:
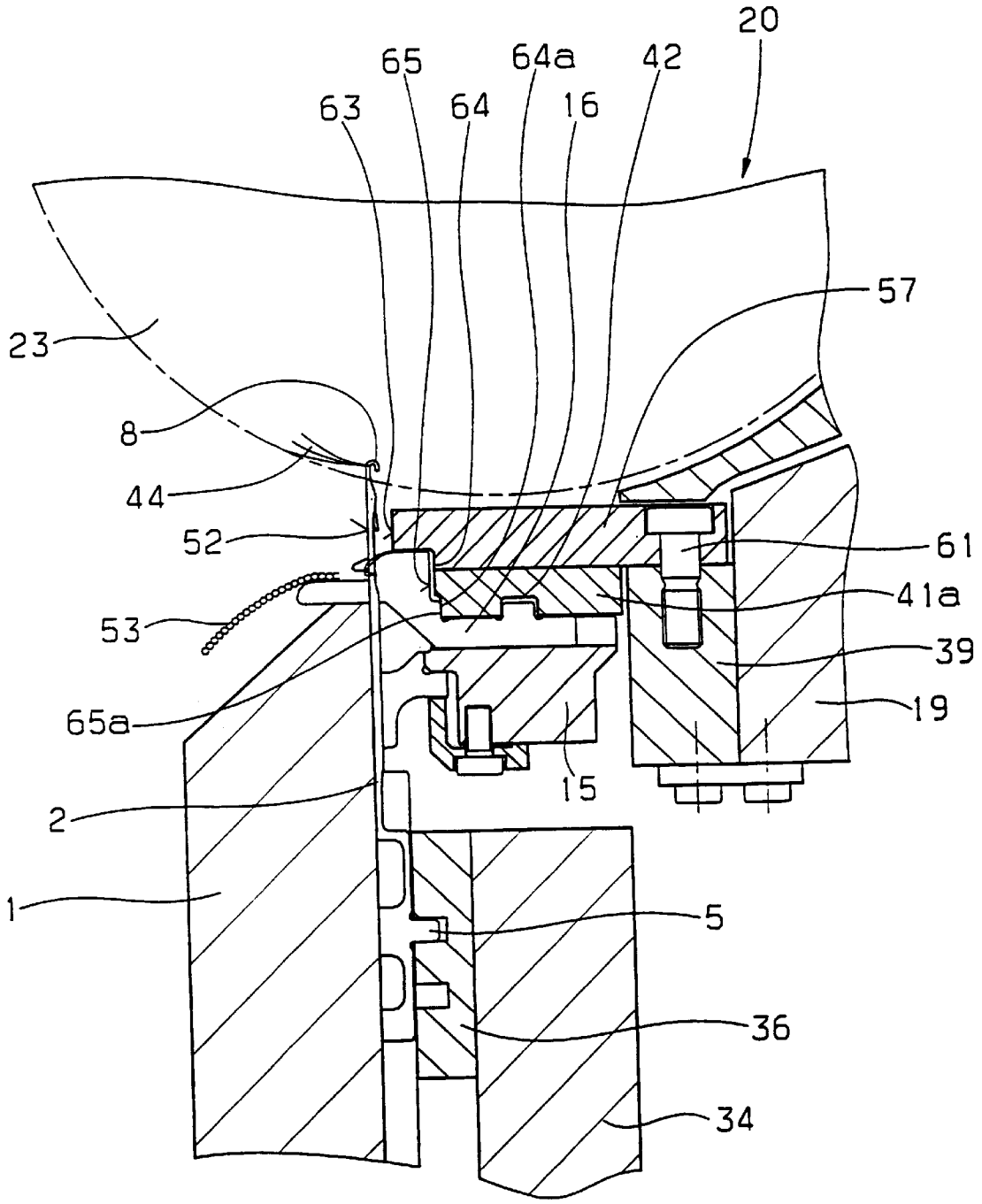
FIGS. 6 to 9 show sections along lines VI—VI to IX—IX of FIGS. 4 and 5.

In accordance with FIGS. 4 and 6, the segments 57 in advance of segments 58 in the rotating direction of the needle cylinder are constructed in a continuously identical manner in cross section. The sinkers 16 are held by the cam parts 41*a* and by the path 42 in a position such that they are pushed forward radially inward so that, in this area, the loops formed in a preceding system are cleared when the feet 5 of the knitting needles 2 according to FIG. 5 are guided in path portion 37 in order to take up fibers (see also FIG. 6). The knitting needles 2 and sinkers 16 then pass the dividing line 59 (FIG. 4) and reach the segment 58 which is divided, according to invention, into several portions. In a first portion shown through section line VII—VII and FIG. 7, segment 58 is essentially provided with the same cross-sectional shape as segment 57 (FIG. 6). In contrast to this, however, a holder 66 for the yarn feed device 24 is provided on its upper side in order to be able to offer the yarn 25 to the knitting needles 2 passing by in the raised position. The yam 25 is fed to the knitting needles 2 passing path portions 37 as well as to the knitting needles 2 passing path portions 38 after they have taken up fibers in the case of a fiber feed device 20 located further in front. The paths traversed by the hooks 8 of the knitting needles 2 are designated by line 48 in FIG. 5.

After the yam 25 is taken up, the needles are guided to the loop forming point 49 and the sinkers 16 are simultaneously retracted as is indicated in FIG. 4 by a corresponding curve in the path 42. To enable the swiveling of the needle latches 9 (latch stroke) required for loop formation, the latch guard 63 has a gap 67 in this area (FIGS. 4, 5), while at the same time the relief cut 64 and the guide surface 64*a* have a radially outwardly directed bend corresponding to the curvature in the path 42. This can be seen in FIG. 4 as well as in FIG. 8 in which the sinker 16 is in a retracted position, so that the knitting needles 2 can lay the yarn 25 over the cast off edge 54 in conventional manner and form loops.

Figure 8:
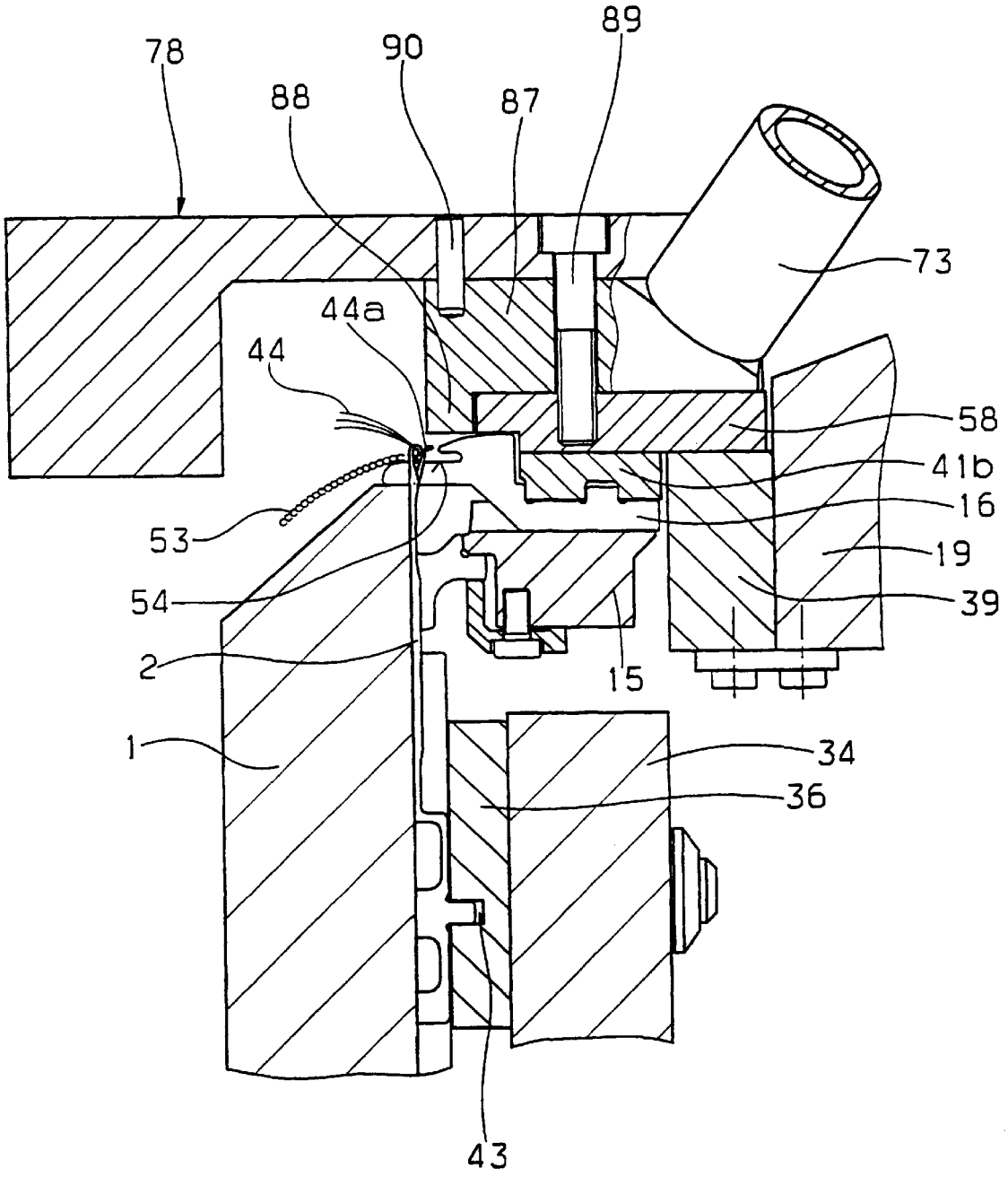

Following the portion of segment 58 shown in FIG. 8 is a portion which can be seen from FIGS. 4, 5 and 9 to 12 and which also contains the air guiding unit 45 according to the invention. An essential component of this air guiding unit 45 is a free space 69 which is arranged on the front sides 55 of the knitting needles 2 and above the sinkers 16. The free space 69 extends in the rotating direction of the needle cylinder (arrow v) roughly from the loop forming point 49 to location 51 according to FIG. 5 and over a preselected part of the following raising path portion 50 and at a height, i.e., parallel to the axis of rotation, approximately from upper edges 70 (FIGS. 5, 9 and 11) of the sinkers 16 to a location situated sufficiently far above the upper edges 70. The upper edges 70 refer to the sinker edges located at the highest point. In the embodiment example, the free space 69 is formed by the hollow interior of a hollow body 71 and is defined at the sides and at the top and bottom by its walls. In the front, i.e., toward the knitting needles 2, the hollow body 71 has an inlet opening 72 which preferably extends along the entire cross-sectional surface of the free space 69, while it is closed toward the opposite end up to an outlet opening which opens into a connection piece 73 (FIGS. 4, 5 and 11) which, e.g., is connected to a suction line, not shown. The free space 69 and the hollow body 71 act as a suction nozzle in this case. The hollow body 71 is fastened by means of screws 80 preferably to a surface of segment 58 extending transverse to the axis of rotation (FIG. 9), which segment 58 has a cutout 74 at this location in which the hollow body 71 is inserted as can be seen from FIG. 9.

Further, according to FIGS. 4, 5 and 9 to 11, the air guiding unit 45 of the described embodiment example of the invention which is currently considered the best has a blowing nozzle 75, e.g., a tubular blowing nozzle 75, with a flattened outlet opening 76 at the front side. The blowing nozzle 75 is connected in back with a line 77 leading to a compressed air source, not shown.

Figure 9:
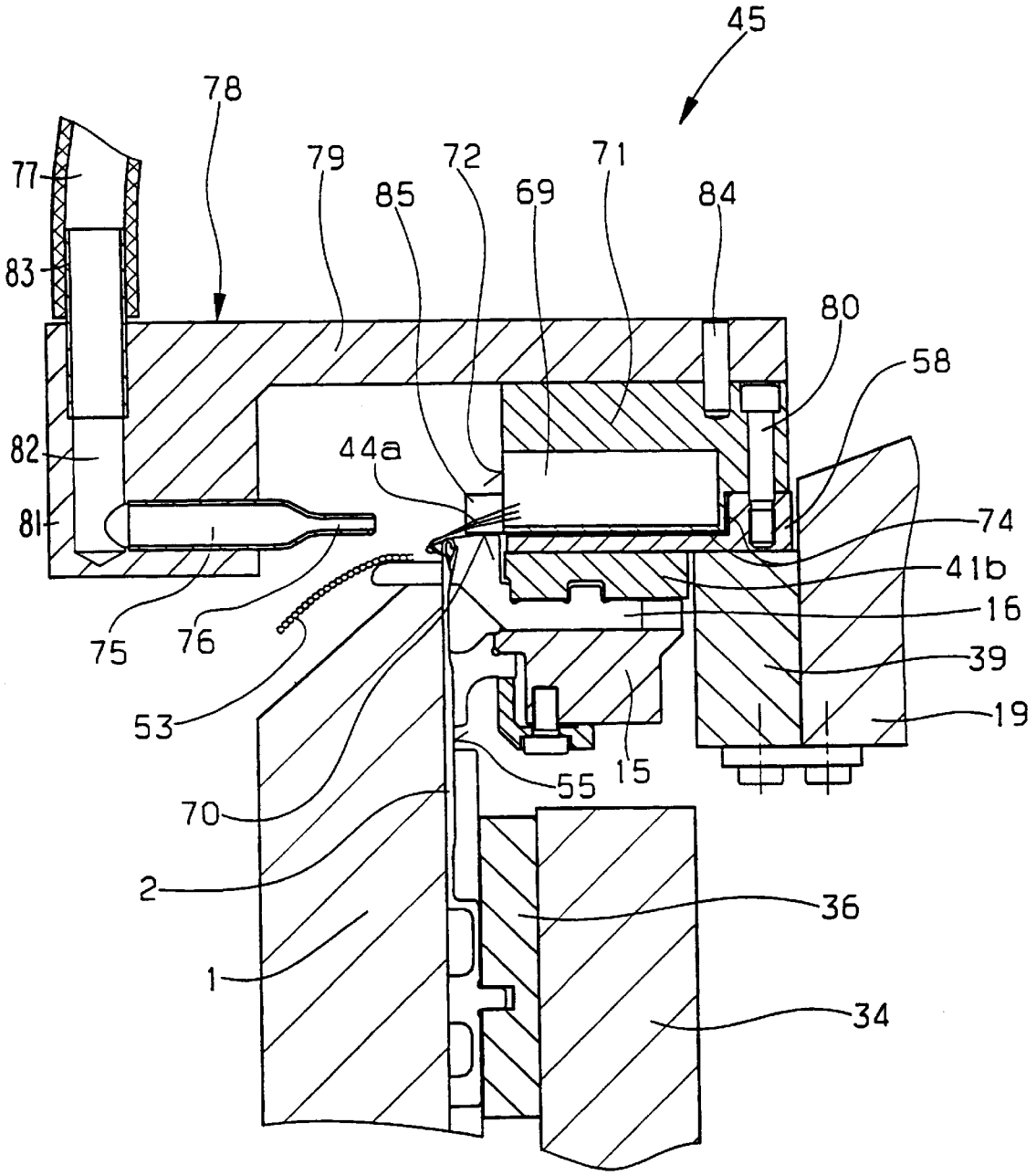

As is shown particularly in FIGS. 10 and 11, the hollow body 71 and the blowing nozzle 75 are preferably fixedly connected with one another to form a blowing/suction block which is fastened in its entirety to segment 58 (FIG. 9). For this purpose, the blowing nozzle 75 is mounted at the underside of an L-shaped carrier 78 extending substantially radially, the long arm 79 of this L-shaped carrier 78 being fastened to segment 58 by at least one fastening screw 89 (FIG. 8) which projects through both the long arm 79 and the hollow body 71. The blowing nozzle 75 is mounted at the free end of the short arm 81 of the carrier 78. At the rear end, the blowing nozzle 75 opens into a passage which penetrates the arm 81 and in which is inserted a connection piece 83 serving for connecting to line 77.

Figure 12:
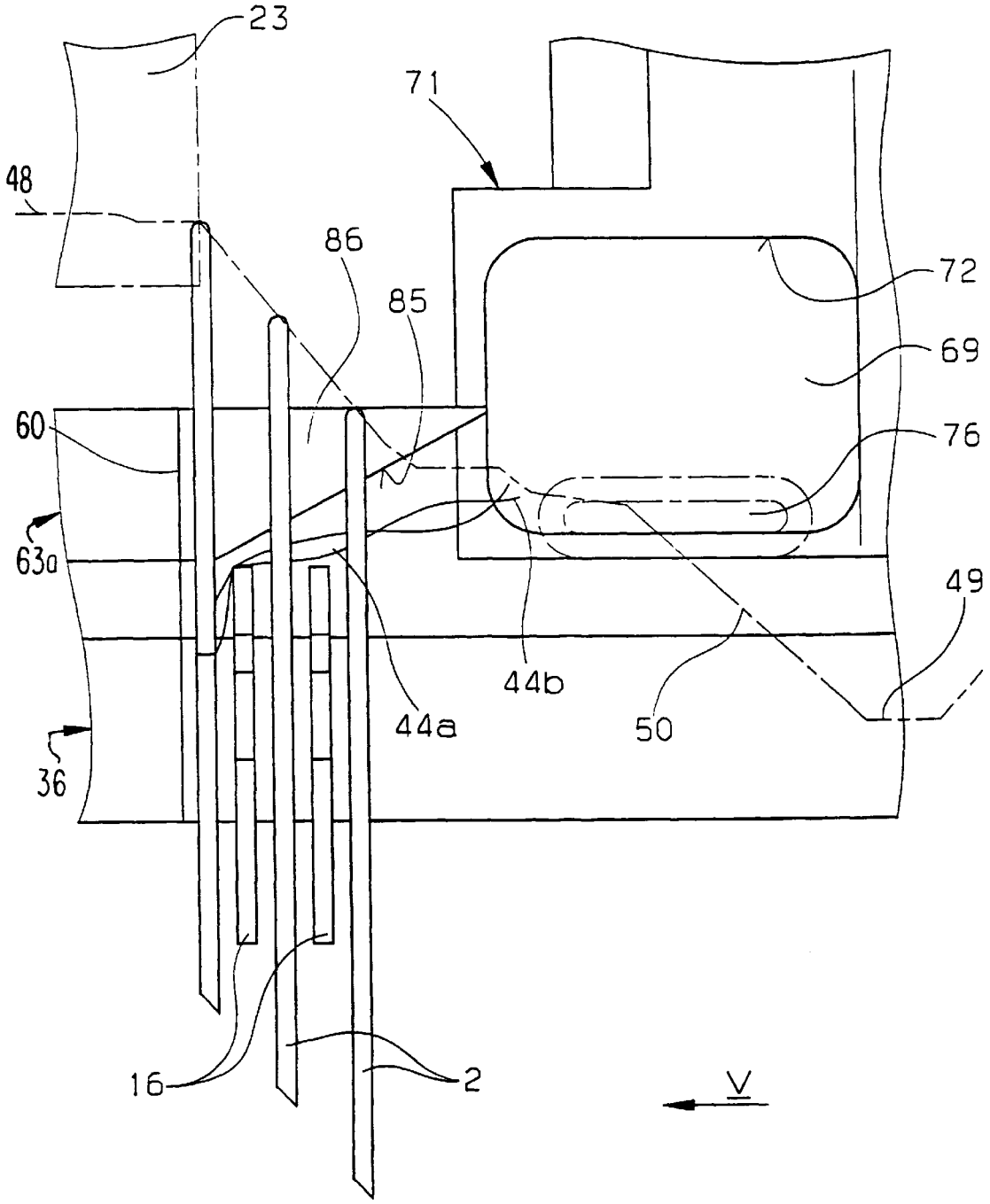
FIG. 12 shows an enlarged detail X from FIG. 5, in addition to some knitting needles and sinkers shown schematically.

The projection of the outlet opening 76 of the blowing nozzle 75 relative to the free space 69 is shown in dashed lines in FIGS. 5 and 12. The projection is along the center line of the blowing nozzle 75. The blowing nozzle 75 preferably has an inner cross section which is smaller than the inner cross section of the inlet opening 72 of the hollow body 71. Further, the position of the blowing nozzle 75 is selected in such a way that the lower boundary of the outlet opening 76 is located in extension of the lower boundary of the inlet opening 72 or, in any event, is not as low as the latter and is oriented, in the rotating direction of the needle cylinder 1 (arrow v in FIG. 12), roughly in the center of the inlet opening 72 and the free space 69. In this way, an air flow exiting from the blowing nozzle 75 is blown into the free space 69 essentially without obstruction and, therefore, without whirling and is sucked out of the free space 69 via the connection piece 73. This results in an effective volume flow which reverses the fiber tufts 44 uniformly in the direction of the axis of the blowing nozzle 75. This is true particularly when the suction velocity in the free space 69 is selected high enough that the volume flow coming from the outlet opening 76 is accelerated when entering into the inlet opening 72 of the free space 69.

The described arrangement has the advantage that the fiber reversal functions well and reliably and is also extensively independent from the fiber length and type of fiber. Therefore, it is possible to adjust the position of the blowing nozzle 75 in a fixed manner with respect to the hollow body 71, e.g., through the use of two alignment pins 84 and 90 (FIGS. 9 and 8) which penetrate both the blowing nozzle 75 and hollow body 71 and which secure the given position of the carrier 78 relative to the free space 69 after the fastening screw 89 is screwed in. Therefore, no cumbersome adjustment and alignment work need be carried out.

Figure 13:
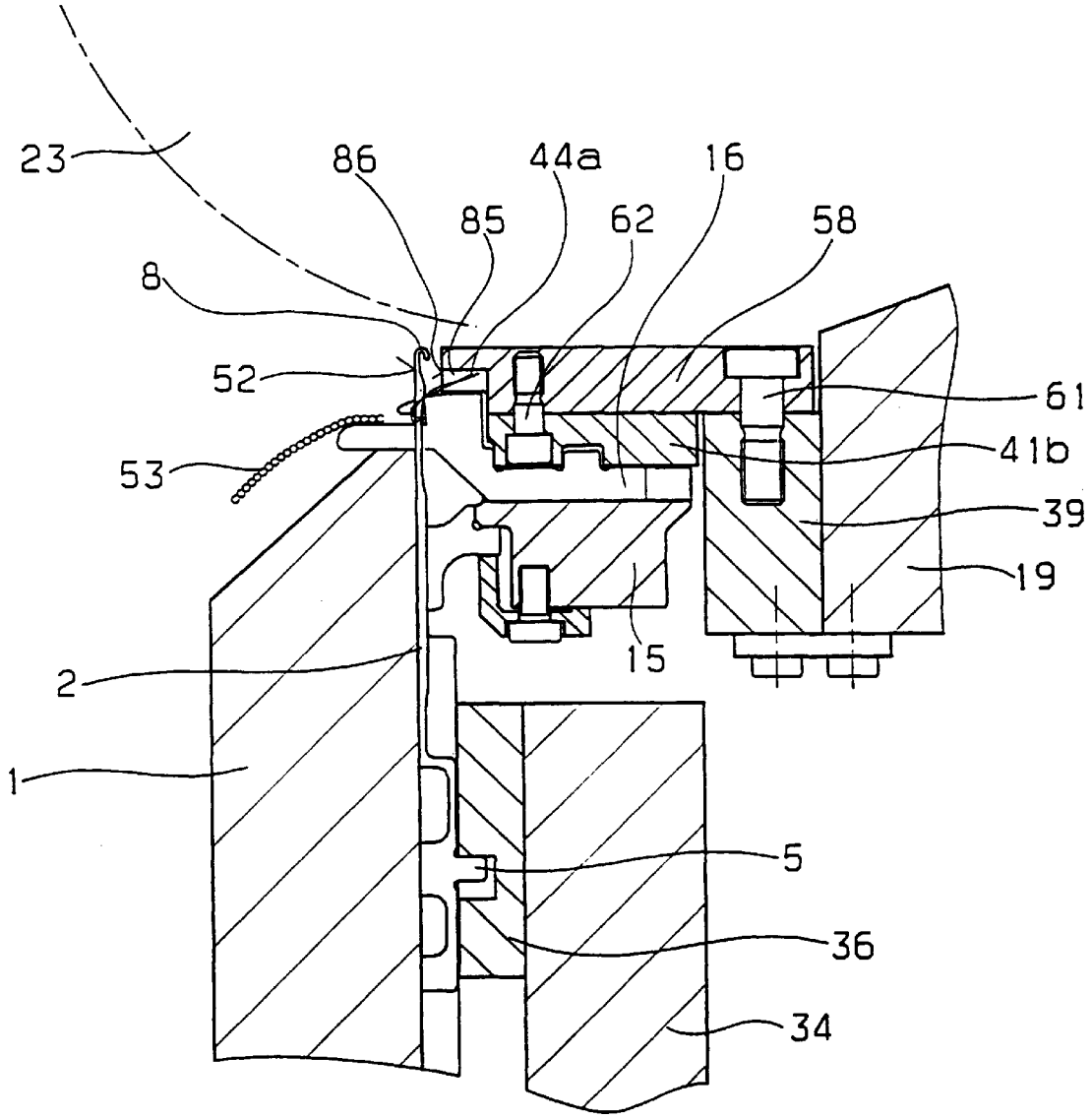
FIG. 13 shows a section along line XIII—XIII of FIGS. 4 and 5.

As is shown especially in FIGS. 12 and 13, a control cam 85 is arranged behind the blowing/suction block 71, 75, 78 in the rotating direction of the needle cylinder, which control cam 85 starts parallel to the axis of rotation in a middle area of the free space 69 and its inlet opening 72. Proceeding from this area and considered in the rotating direction of the needle cylinder 1, the control cam 85 is formed with a gradual drop-off and passes into a latch guard 63*a* of the following segment which is separated by the dividing line 60, this segment being constructed identical to segment 57, for example. The control cam 85 is formed at the underside and at the front end of a fiber guide piece 86 which is constructed in one piece with the sinker cam segment, for example (FIG. 13), but could also be a separate part. Further, the control cam 85 is arranged at a location (FIG. 12) where the knitting needles 2 which are only partially raised in the area of the free space 69 but which are already provided with reversed fiber tufts 44*a* are raised farther in a selected manner so as to take up fibers again or run into the path portion 38 (FIG. 5). In both cases, the control cam 85 rests from above on the fiber tufts 44*a* carried by the knitting needles 2, so that these fiber tufts 44*a* are increasingly deflected laterally along the diagonal control cam 85 and are accordingly placed on the sinkers 16 diagonally, i.e., at an angle forming an angle respectively with the associated radii. The fiber tufts 44*a* are accordingly placed in a controlled and uniform manner in such a way that the next time the knitting needles 2 are lowered the fiber tufts 44*a* are once again grasped by their hooks 8 at a following loop forming point 49 or are placed flat on the front side of the knitwear 53 through the next knitted yam 25. This process is also intensified in that free ends 44*b* of the combed fiber tufts 44*a* according to FIG. 12, because of their length, even remain in the effective area of the free space 69 for a period of time and are therefore automatically moved into an inclined position when the tied up ends of the fiber tufts have already passed its inlet opening 72 as is indicated by a fiber tuft 44*b* in FIG. 12.

It is particularly advantageous when a cover part 88 (e.g., FIGS. 4, 5 and 8) is allocated to the air guiding unit 45 in addition, which cover part 88 covers the space between the gap 67 required for the latch stroke and the hollow body 71 and free space 69, has a projection projecting beyond the segment 58, and controls the fibers in an optimum manner at this location. In this way, after their insertion in the hooks 8 and before they reach the free space 69, the fiber tufts 44 are, in any case, in the effective area of the conventional exhaust hood or other suction sources, not shown in the drawing, but not yet in the effective area of the free space 69 and are accordingly initially oriented only toward the inside analogous to FIG. 6. Therefore, until the free space 69 is reached, they are extensively shielded from its suction sources and blowing nozzle 75 so that no unwanted turbulence can result. When passing the leading inner edge of the inlet opening 72, on the other hand, the fiber tufts 44 abruptly arrive in an oppositely directed air flow which favorably influences the fiber reversal.

Also, in this way, the fiber tufts 44*a* which are turned around in the preceding knitting system and which lie in the area of the drawing-down cam 43 approximately tangential to the outer diameter of the cylinder above the hold-down sinkers 16 and are located in the effective area of the conventional exhaust hood or other suction sources, not shown in the drawing, are extensively shielded from the suction source of the free space 69 and blowing nozzle 75 until reaching the loop forming point 49. Accordingly, up to the loop forming point 49 there occurs no unwanted turbulence, which favorably influences the ordered tying in of the approximately tangential fiber tufts 44*a*.

The cover part 88 and the hollow body 71 can be combined in one part (FIGS. 2, 3, 4 and 5), but can also form two separate parts.

A further advantage results through the arrangement, according to the invention, of the dividing lines 59, 60 (FIGS. 4 and 5) at both sides of the air guiding unit 45 since this makes it possible to create a sufficiently wide free space 69 which is nevertheless free of obstructions and the segment 58, including the complete air guiding unit 45, can be fastened as a unit to the sinker cam carrier by means of fastening screws 61 in an easy assembly.

On the other hand, if there is a dividing line 59 or 60 essentially in the location where the blowing nozzle and suction nozzle 69, 75 are also arranged, as is the case in known circular knitting machines, the easy assembly described above is not provided and the dividing line below the air guiding unit 45 becomes a dirt collector, so that trouble-free permanent operation is not possible.

Finally, an advantage of the present invention consists in that the control cam 85 and the fiber guide piece 86 corresponding to FIG. 12 extend just up to the free space 69 but do not project into the latter and are constructed in such a way that the fiber guide piece 86 can also act as a latch guard (e.g., FIG. 4).

Figure 15:
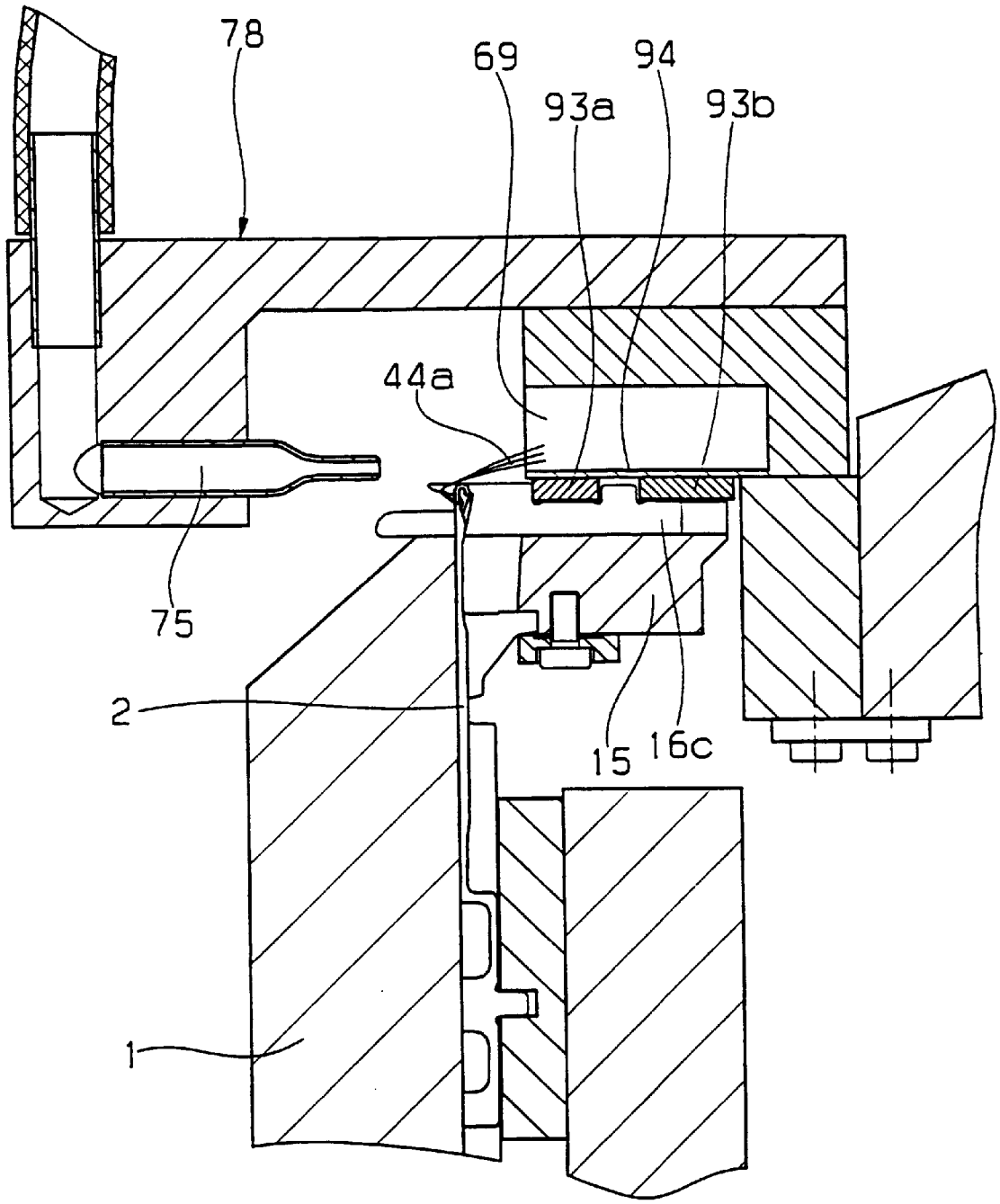
Figure 16:
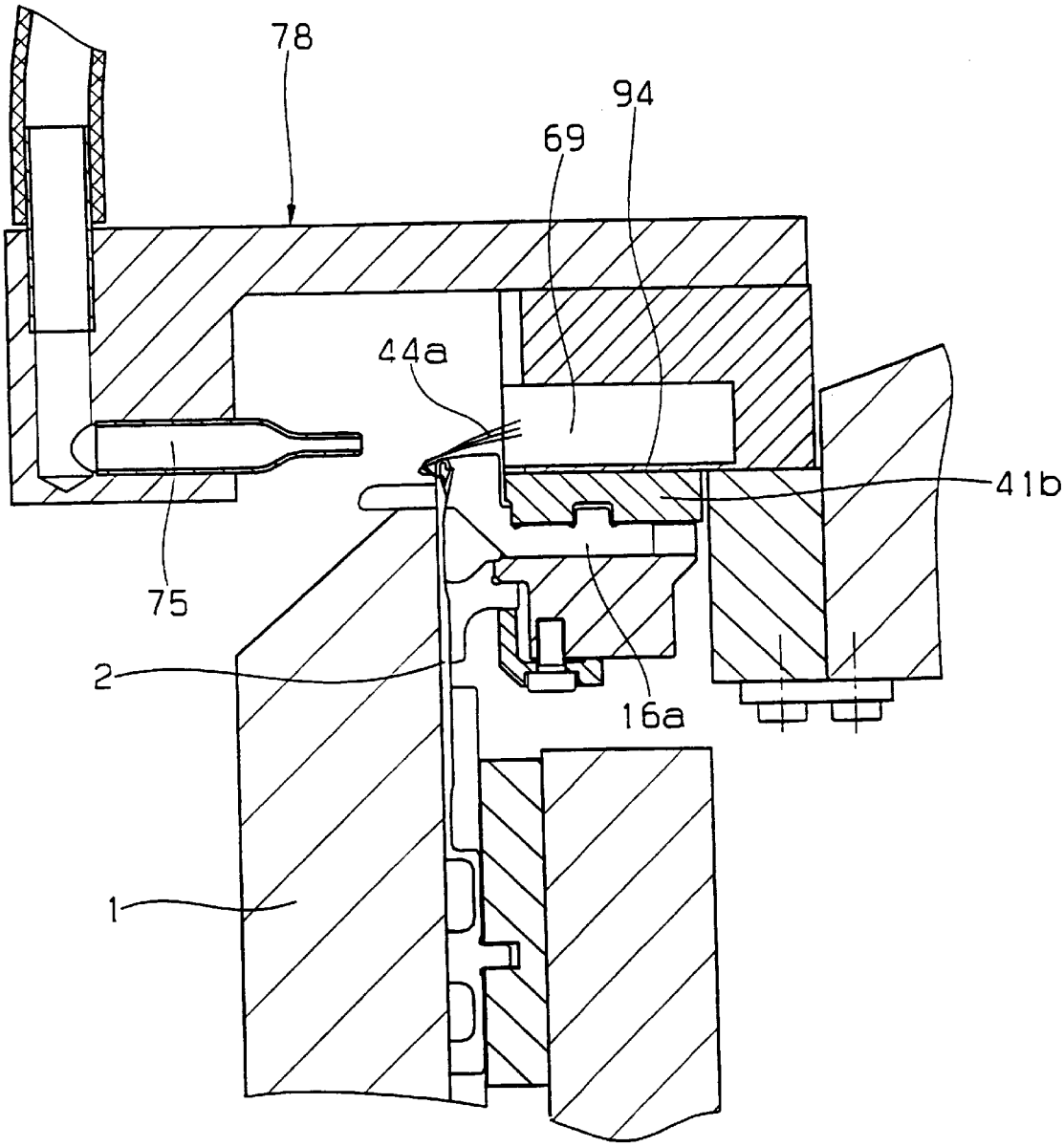

The above-described sinker cam, including the air guiding unit 45, can be modified in many ways. Three such modifications are shown in FIGS. 14 to 16.

FIG. 14 shows, in the bottom part, two sinkers 16*a* and 16*b*, wherein sinker 16*a* corresponds to the sinkers 16 used in the embodiment example according to FIGS. 1 to 13. Sinker 16*a* is distinguished in that the butt 17 and the shoulder 65*a*, in contrast to known hold-down sinkers 16*c* (FIG. 15), are appreciably lower relative to the upper edge 70 and a cutout 92 is accordingly formed at a location lying close behind the actual sinker head. As a comparison of FIGS. 14 and 15 will show, the cutout 92 serves to receive the cam parts 41*b* with the result that their upper surfaces can come to rest appreciably below the upper edges 70 even when the cam parts 41*b* are constructed in one piece corresponding to FIG. 14.

When sinkers 16*c* (FIG. 15) are used it is generally necessary to use two separate cam parts 93*a* and 93*b*. Even when these cam parts 93*a* and 93*b* are fastened directly to a base 94 (FIG. 14) of the hollow body 71, i.e., a portion 95 (FIG. 14) of the segment which would otherwise lie below this hollow body 71 is done away with in its entirety, the free space 69 can usually first start above the upper edges 70 of the sinkers 16*c* as is made clear by FIG. 15. On the other hand, if the segment portion 95 is also omitted (FIG. 16) when using the sinker 16*a* and if the base 94 of the hollow body 71 is constructed so as to be thin, the free space 69 can even start below the upper edge 70 of the sinker 16*a* when a one-piece cam part is used, as can be seen from FIG. 16. Accordingly, given a correspondingly lower arrangement of the blowing nozzle 75, the fiber tufts can be laid on the sinker in a particularly flat manner. For the same reason, it is recommended that the front sides of protuberances 96 of the sinkers 16, 16*a*, in contrast to sinkers 16*b* and 16*c*, are provided with an inclined surface 97 which rises diagonally toward the upper edge 70, wherein the angle of inclination of the inclined surface 97 need only amount to a few degrees.

A particularly advantageous sinker construction with respect to reversal of the fiber results when the sinkers 16*am* 16*b* are provided at a location below the cast off edge 54 with a diagonally angled portion 98 which passes into a shaft part 99 having foot 17, so that the lower edge of the sinkers 16*a*, 16*b* is stepped. Accordingly, the depth of the cutout 92 is substantially increased.

Finally, as is shown in FIGS. 4 and 14, the axis of the blowing nozzle 75 can form an angle with a radius proceeding from the axis of rotation and extending vertical thereto, namely in the horizontal direction (FIG. 4) as well as in the vertical direction (FIG. 14), wherein it is assumed that the circular knitting machine normally has a vertical axis of rotation which conforms to the center axis of the needle cylinder 1.

The invention is not limited to the described embodiment examples which can be modified in many ways. For one, it does not matter how the fibers are combed into the knitting needles. Instead of take-off rollers, devices operating in a noncontacting manner are also known for this purpose. It is also inconsequential whether a single-color pile fabric, a multi-colored pile fabric, a base knit with patterned structure or a smooth base knit is to be produced. In particular, it is possible to provide between the described knitting systems additional systems where only one yam is inserted in the knitting needles in order to form a smooth course. Further, it is advisable, as is shown in FIG. 4, to carry out the separation of the segments in such a way that the width of the segment is everywhere identical and the segments shown in FIGS. 2 and 4 can be replaced, if necessary, by other segments used for different purposes. Moreover, it is possible to provide sinker cam parts which do not have the portions for retracting and advancing the sinkers as shown in FIG. 4 in those system portions in which only fibers, but not yarns, are inserted, i.e., in which no loops are formed. This is shown, for example, in FIG. 2 for the area between the two middle fiber feed devices 20.

According to another important feature of the invention, it is possible to use only one suction nozzle (hollow space and suction line connection) or only one blowing nozzle 75 or both. In particular, this is because it can be sufficient for generating a uniform air flow when the air flow given off by the blowing nozzle 75 opens into a sufficiently large free space or when the free space 69 is only used for producing a sufficiently strong suction current. In every case, it is advisable also to select a sufficiently large length of the free space 69 (e.g., FIG. 9) vertical to the axis of rotation so that the impingement of the air flow generated by the blowing nozzle or suction nozzle on wall portions located farther back cannot cause any detrimental turbulence. Therefore, in the simplest case, the free space 69 is realized by a sufficiently large hole in the sinker cam. The arrangement used in any particular instance depends to a great extent on the individual instance and can, if necessary, easily be determined by experimentation. Moreover, it is evident that the rest of the features of the invention can also be used in combinations other than those shown and described herein.

It will be understood that each of the elements described above, or two ore more together, may also find a useful application in other types of constructions differing from the types described above.

While the invention has been illustrated and described as embodied in a circular sliver knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Circular knitting machine for the production of knitwear (53) formed of at least one yarn (25) and fibers (44) tied into this yarn (25), comprising a needle cylinder (1) with knitting needles (2), a sinker ring (15) with sinkers (16) having upper edges (70) and being mounted so as to be rotatable about an axis of rotation jointly with said needle cylinder (1), and a stationary cylinder cam and sinker cam means being associated with said knitting needles (2) and sinkers (16), respectively, and forming at least one knitting system extending in a rotating direction of said needle cylinder (1), said knitting system having at least one cylinder cam part (36) for raising and drawing off said knitting needles (2), yarn and fiber feed means (24, 20) for feeding and inserting said yarn (25) and fiber tufts (44) in raised knitting needles (2), at least one sinker cam part (41) for advancing and retracting said sinkers (16), and an air guiding unit (45) provided with at least one nozzle selected from the group consisting of a suction nozzle and a blowing nozzle, wherein said cylinder cam part and sinker cam part (36, 41), said yarn and fiber feed means (24, 20) and said air guiding unit (45) being operative for forming initially loops from said yarn (25) and said fiber tufts (44), said fiber tufts (44) being directed essentially toward the axis of rotation, said air guiding unit (45) reversing the direction of the fiber tufts (44) substantially and the reversed fiber tufts (44*a*) are laid over adjacent sinkers (16) so that they can take part at least once in a loop forming process when passing through a knitting system, and wherein said air guiding unit (45) has a free space (69) arranged on a front side (55) of said knitting needles (2) and above said sinkers (16), said free space (69) extending in a rotating direction of said needle cylinder essentially from a location (49) at which raising of said knitting needles (2) starts, along a preselected part of a subsequent raising portion (50), and extending in a direction parallel to said axis of rotation until close to said upper edges (70) of the sinkers (16).

2. Circular knitting machine according to claim 1, wherein in said air guiding unit (45) is integrated in said sinker cam means.

3. Circular knitting machine according to claim 1, wherein said free space (69) is formed by a hollow body (71) which has an inlet opening (72) facing said knitting needles (2).

4. Circular knitting machine according to claim 3, that said hollow body (71) can be fastened to an upper side of said sinker cam.

5. Circular knitting machine according to claim 3 or 4, in that said hollow body (71) has, at a side remote of said knitting needles (2), a connection piece (73) serving for the connection to a suction source.

6. Circular knitting machine according to of claim 1, wherein a blowing nozzle (75) is provided on a back (52) of said knitting needles (2), said blowing nozzle (75) being arranged essentially radially, being connectable to a compressed air source and having an outlet opening (76) being oriented in a direction of said free space (69).

7. Circular knitting machine according to claim 6, said blowing nozzle (75) is fastened to a carrier (78) which can be connected with said hollow body (71).

8. Circular knitting machine according to claim 6, wherein said outlet opening (76) is oriented to a portion of said free space (69), said portion directly adjoining said upper edges (70) of said sinkers (16).

9. Circular knitting machine according to claim 6, wherein said outlet opening (76) has a smaller inner cross section than said inlet opening (72) of said hollow body (71).

10. Circular knitting machine according to claim 1, wherein a control cam (85) is provided, said control cam (85) starting—considered in the rotating direction of said needle cylinder (1)—at a rear side edge of said inlet opening (72) of said hollow body (71) and, from there, gradually drops off in a direction of a latch guard part (63*a*).

11. Circular knitting machine according to claim 10, wherein said control cam (85)—considered parallel to said axis of rotation—begins in a central area of aid free space (69).

12. Circular knitting machine according to claim 1, wherein said air guiding unit (45) has a cover part (87,88) arranged in front of said free space (69) considered in said rotating direction of said needle cylinder (1), said cover part (87,88) extending in a direction parallel to said axis of rotation over an entire height of said free space (69) and in a circumferential direction directly up to said free space (69), but does not project into an air flow brought about by said air guiding unit.

13. Circular knitting machine according to claim 12, wherein said cover part (88) extends in a radial direction until close to said knitting needles (2).

14. Circular knitting machine according to claim 1, wherein said sinkers (16) are constructed as hold-down sinkers and have cast off edges (54) and protuberances (96) at front ends associated with said knitting needles (2).

15. Circular knitting machine according to claim 14, wherein said sinkers (16*a*, 16*b*) are provided with butts (17) and shoulders (65*a*) located below said upper edges (70).

16. Circular knitting machine according to claim 14, wherein said sinkers (16*a*, 16*b*) are provided with a stepped lower edge.

17. Circular knitting machine according to claims 14, wherein said sinkers (16) are provided at rear sides thereof with cutouts (92) for receiving said sinker cam part (41*b*).

18. Circular knitting machine according to claim 14, wherein said protuberances (96) are beveled at front ends thereof.

19. Circular knitting machine according to claim 14, wherein said sinker cam part (41*b*) has a surface ending below said upper edges (70) of said sinker (16*a*) and wherein said free space (69) reaches until close to said surface.

20. Circular knitting machine according to claim 1, wherein said sinker cam means is divided into a plurality of segments (57, 58) which are divided from one another by dividing lines (59, 60) extending essentially radial to said axis of rotation, and wherein said air guiding unit (45) is arranged between two such dividing lines (59, 60).

21. Circular knitting machine according to claim 1, wherein said knitting system has a control cam (85) for acting on said reversed fiber tufts (44*a*) and wherein said free space (69) extends from said location (49) to a beginning of said control cam (85).

* * * * *